US005458463A

United States Patent [19]

Chiang

[11] Patent Number: 5,458,463

[45] Date of Patent: Oct. 17, 1995

[54] LIGHTWEIGHT FITTING FOR A CEILING FAN

[76] Inventor: Ming-Ann Chiang, No.44, Lane 67, Sec.1, Ya-Tan Rd., Tan-Tzu Hsiang, Taichung Hsien, Taiwan

[21] Appl. No.: 331,003

[22] Filed: Oct. 28, 1994

[51] Int. Cl.[6] ..... F04D 29/34

[52] U.S. Cl. ..... 416/210 R; 416/5

[58] Field of Search ..... 416/5, 204 R, 416/210 R, 229 R, 241 A, 244 R

[56] References Cited

U.S. PATENT DOCUMENTS 5,222,864 6/1993 Pearce ..... 416/5

5,330,323 7/1994 Swanson ..... 416/5

*Primary Examiner*—Edward K. Look

*Assistant Examiner*—James A. Larson

*Attorney, Agent, or Firm*—Harness, Dickey & Pierce

[57] ABSTRACT

A fitting for connecting components of a ceiling fan includes a plastic-molded body with a plurality of reinforcing ribs and a plurality of threaded bores formed integrally thereon, and a reinforcing metal member embedded in the plastic-molded body.

5 Claims, 3 Drawing Sheets

LIGHTWEIGHT FITTING FOR A CEILING FAN

BACKGROUND OF THE INVENTION

1. Field of the Invention

The invention relates to a fitting, more particularly to a fitting for connecting components of a ceiling fan.

2. Description of the Related Art

FIG. 1 shows a ceiling fan 10 which includes a hanging support rod 11, a motor casing 12 which is connected to one end of the support rod 11 and which encloses a rotating motor therein, a plurality of fan blades 14 connected securely to the rotating motor by means of a plurality of fittings 13, and a control box 15.

FIG. 2 is an enlarged view of the conventional fitting 13 shown in FIG. 1. The fitting 13 is a cast body with a plurality of threaded bores 131 formed therethrough. Zinc is melted in a furnace, generally at a temperature of about 400 degrees centigrade, and is then poured into a mold which has a cavity that conforms with the shape of the conventional fitting 13 to form the latter.

Some of the drawbacks that result with the use of the conventional fitting 13 are as follows:

(1) The components of the ceiling fan are fastened together by the use of the zinc fittings 13, which are relatively heavy and which increase the load of the ceiling fan.

(2) After the die-casting process, the cast body does not possess the threaded bores 131. The threaded bores 131 are drilled through after forming the cast body to permit extension of the screws for fastening the components of the ceiling fan. This results in additional work and expense.

(3) After the die-casting process, cavities may be formed within the cast body, and pock marks, scratches or burrs may be formed on the external surface of the cast body, thereby degrading the appearance of the ceiling fan.

(4) Additional work, such as smoothing, polishing and electroplating is needed to enhance the appearance of the fitting 13.

(5) In order to prevent any unfortunate accident from occurring when casting at high temperatures, extreme precaution must be undertaken, thereby resulting in added cost.

SUMMARY OF THE INVENTION

The main objective of the present invention is to provide a lightweight fitting for connecting components of a ceiling fan, the fitting being relatively easy to produce at a relatively low cost.

Accordingly, the fitting of this invention is used to connect components of a ceiling fan and comprises a plastic-molded body with a plurality of reinforcing ribs and a plurality of threaded bores formed integrally thereon, and a reinforcing metal member embedded in the plastic-molded body.

In the disclosed embodiment, the plastic-molded body is preferably flat and includes a first portion to be connected to a fan blade of the ceiling fan, a second portion to be connected to a rotating unit of the ceiling fan, and an elongated intermediate portion interconnecting the first and second portions, thereby forming an integral block which is confined by a periphery. The plastic-molded body further includes a flange portion which extends along a part of the periphery to confine a recess therein. The reinforcing ribs are disposed in the recess. The reinforcing metal member is a flat plate which is disposed in the recess. The plastic-molded body has a number of annular walls which project integrally therefrom and which are disposed in the recess. The annular walls confine the number of the threaded bores which pass through the reinforcing metal plate. Each of the threaded bores can be constituted by an annular wall which projects integrally from the plastic-molded body and which has a screw nut bound fixedly in the annular wall. The threaded bore can also be constituted by an internally threaded annular wall which projects integrally from the plastic-molded body.

Since plastic is used to form a portion of the fitting of the present invention, the fitting is relatively light in weight. In order to enhance strength and rigidity of the fitting a reinforcing metal plate is embedded in the interior of the fitting.

BRIEF DESCRIPTION OF THE DRAWINGS

Other features and advantages of the present invention will become more apparent in the following detailed description of the preferred embodiment with reference to accompanying drawings.

DETAILED DESCRIPTION OF THE PREFERRED EMBODIMENT

Figure 1:
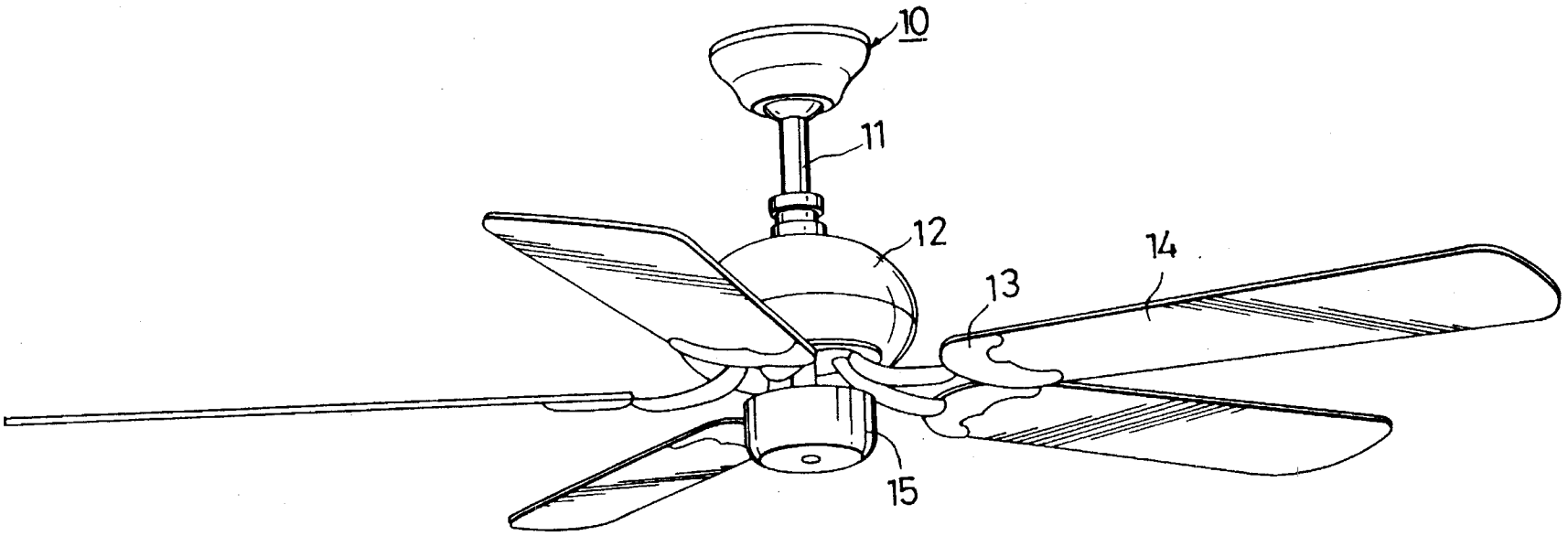
FIG. 1 PRIOR ART
FIG. 1 shows a ceiling fan in which a conventional fitting is used to connect a fan blade and the rotating motor of the ceiling fan.
Figure 2:
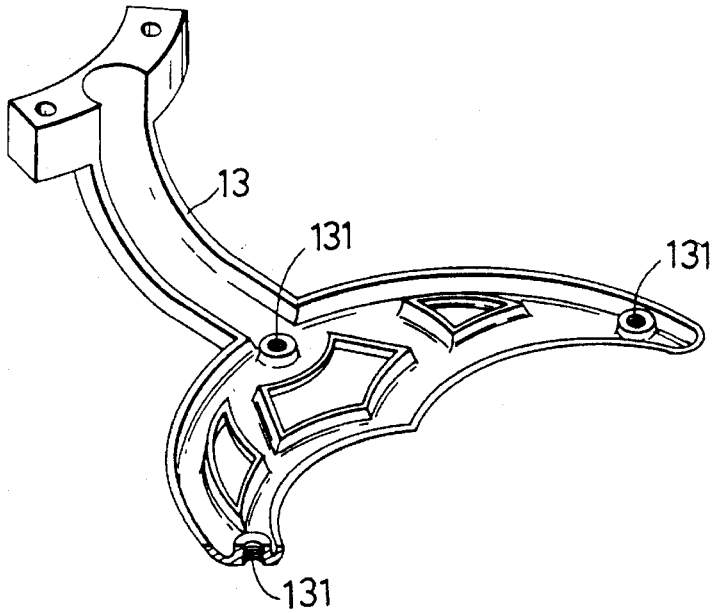
FIG. 2 PRIOR ART
FIG. 2 is an enlarged view of the conventional fitting shown in FIG. 1.
Figure 3:
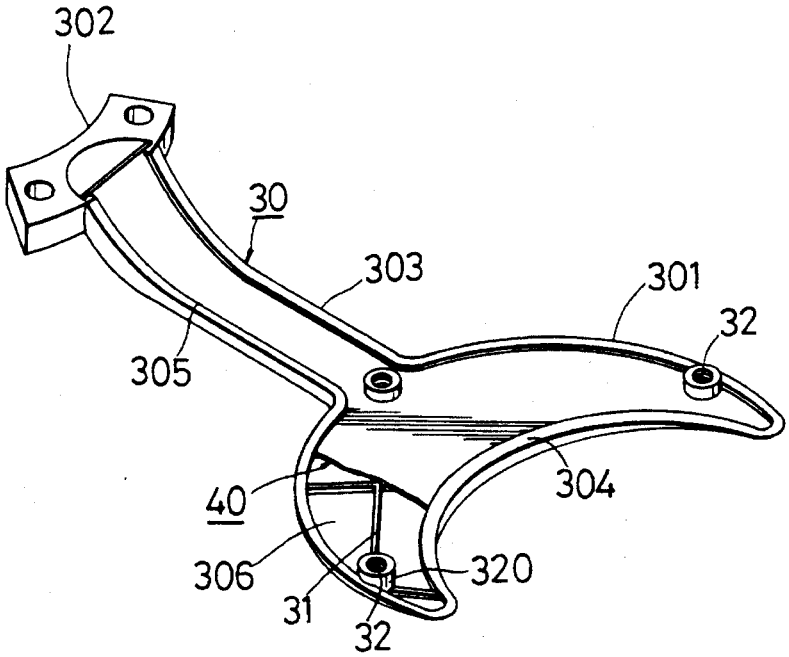
FIG. 3 shows a fitting of the present invention for connecting components of a ceiling fan.

Referring to FIG. 3, a fitting of the present invention is used for connecting components of a ceiling fan and includes a plastic-molded body 30 with a plurality of reinforcing ribs 31 and a plurality of threaded bores 32 formed integrally thereon, and a reinforcing metal member 40 embedded in the plastic-molded body 30.

The plastic-molded body 30 is substantially flat and includes a first portion 301 to be connected to a fan blade of the ceiling fan, a second portion 302 to be connected to a rotating unit of the ceiling fan and an elongated intermediate portion 303 which interconnects the first and second portions 301, 302, thereby forming an integral block which is confined by a periphery 304. The plastic-molded body 30 further includes a flange portion 305 which extends along a part of the periphery 304 so as to confine a recess 306 therein. The reinforcing ribs 31 are disposed in the recess 306. The reinforcing metal member 40 is a flat plate which is disposed in the recess 306.

The first portion 301 of the plastic-molded body 30 has a number of annular walls 320 which project integrally therefrom and which are disposed in the recess 306. The annular walls 320 confine the number of the threaded bores 32 and respectively pass through the reinforcing metal plate 40.

Figure 4:
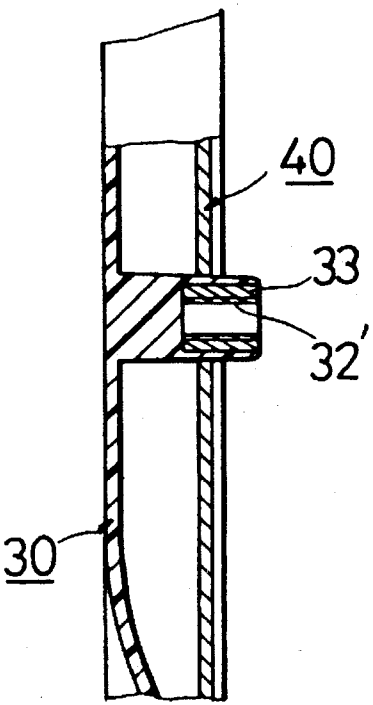
FIG. 4 illustrates how a threaded bore is formed in the fitting of the present invention.

Referring to FIG. 4, during the extrusion of the plastic-molded body 30, a screw nut 32' with an internal screw thread is placed within a mold (not shown) into which a molten plastic material is extruded. After the molten plastic material hardens, the molded body 30 is removed from the mold. At this stage, the screw nut 32' is bound fixedly to the molded body 30 by an annular plastic wall 33, thereby forming a threaded bore in the plastic-molded body 30.

Figure 5:
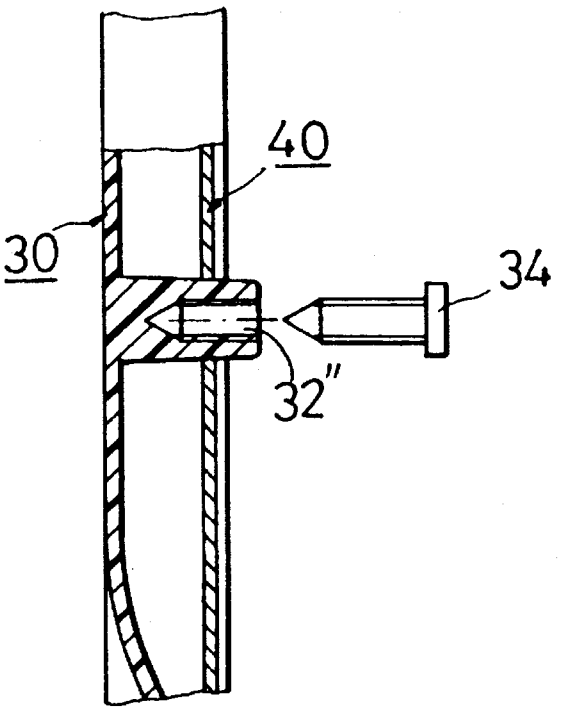
FIG. 5 illustrates another way of forming a threaded bore in the fitting of the present invention.

FIG. 5 shows another way of forming a threaded bore in the plastic-molded body 30. A threaded bolt 34 is placed within a mold into which a molten plastic material is extruded. After the molten plastic material hardens, the threaded bolt 34 is loosened so as to be released from the molded body 30, thereby forming an internally threaded wall 32" on the plastic-molded body 30.

Note that the molded body 30 is made of plastic and therefore has a smooth surface which does not require further smoothing. The weakness of the plastic-molded body 30 is compensated by a reinforcing metal plate 40 that is embedded therein. Thus, the fitting of the present invention is lighter than the conventional fitting but is similar to the former in terms of stiffness and strength. Since plastic is cheaper than metal, the cost of manufacturing can be reduced.

With the invention thus explained, it is obvious to those skilled in the art that various modifications and variations can be made without departing from the scope and spirit of the present invention. Therefore, the invention is intended to be limited only as in the appended claims.

I claim:

1. A fitting for connecting components of a ceiling fan, comprising:

a plastic-molded body with a plurality of reinforcing ribs and a plurality of threaded bores formed integrally thereon; and a reinforcing metal member embedded in said plastic-molded body.

2. The fitting as defined in claim 1, wherein said plastic-molded body is substantially flat and includes a first portion to be connected to a fan blade of said ceiling fan, a second portion to be connected to a rotating unit of said ceiling fan, and an elongated intermediate portion interconnecting said first and second portions, thereby forming an integral block which is confined by a periphery, said plastic-molded body further including a flange portion extending along a part of said periphery so as to confine a recess therein, said reinforcing ribs being disposed in said recess, said reinforcing metal member being a flat plate which is disposed in said recess.

3. The fitting as defined in claim 2, wherein said first portion of said plastic-molded body has a number of annular walls projecting integrally therefrom and being disposed in said recess, said annular walls confining said plurality of said threaded bores and passing through said reinforcing metal plate.

4. The fitting as defined in claim 1, wherein each of said threaded bores is constituted by an annular wall projecting integrally from said plastic-molded body and a screw nut bound fixedly in said annular wall.

5. The fitting as defined in claim 1, wherein each of said threaded bores is constituted by an internally threaded annular wall which projects integrally from said plastic-molded body.

* * * * *